United States Patent [19]

Sabo et al.

[11] 4,206,556

[45] Jun. 10, 1980

[54] NAIL POLISH MACHINE

[76] Inventors: Paul F. Sabo; Margaret B. Spicer, both of 110 Nonquon Rd., Apt. 206, Oshawa, Ontario, Canada, L1G 3S4

[21] Appl. No.: 944,792

[22] Filed: Sep. 22, 1978

[51] Int. Cl.[2] ..... F26B 19/00; A45D 29/22

[52] U.S. Cl. ..... 34/90; 34/88; 34/239; 34/243 R; 132/73.5

[58] Field of Search ..... 34/88, 90, 97, 98, 101, 34/103, 107, 239, 243 R, 202, 233; 132/73.5, 73, 73.6, 75

[56] References Cited

U.S. PATENT DOCUMENTS

| | | | |
|---|---|---|---|
| 2,760,500 | 8/1956 | Johnson, Jr. | 132/73.5 |
| 3,258,853 | 7/1966 | Bradbury | 132/73.5 X |
| 3,712,312 | 1/1973 | Sussman | 132/73.6 |
| 3,757,429 | 9/1973 | Sumino | 34/103 |
| 3,772,508 | 11/1973 | Zapater et al. | 34/88 |

FOREIGN PATENT DOCUMENTS

| | | | |
|---|---|---|---|
| 534230 | 1/1955 | Belgium | 132/75 S |
| 1005277 | 4/1952 | France | 34/202 |
| 540471 | 3/1956 | Italy | 34/243 R |

*Primary Examiner*—William F. O'Dea
*Assistant Examiner*—Harold Joyce

[57] ABSTRACT

A device used for the application of fingernail polish and the like comprises a housing, a finger insert for positioning a finger on the housing, lighting means in the housing for providing direct illuminatin on the finger insert, a motorized fan for drying a polished fingernail, means for actuating the lighting means and the motorized fan, an air inlet in the housing for supplying air to the fan and an air outlet in the housing for directing air blown by the fan at the finger insert so that when a fingernail is polished it is quickly and easily dried without moving the finger to a new location.

2 Claims, 3 Drawing Figures

NAIL POLISH MACHINE

FIELD OF THE INVENTION

This invention relates to a device for illuminating a fingernail to be polished and for blow drying a polished fingernail.

BACKGROUND OF THE INVENTION

Presently used methods of applying fingernail polish and the like to a fingernail consist of placing the hand on which the nails are to be polished on a book or a table beneath a light in a room. After the nails have been polished, the hand is moved rapidly back and forth or blown upon by the nail polish.

The above procedure results in an uneven, unprofessional-like application of the polish due to the fact that the lighting is insufficient to provide a proper illumination on the nails and the fact that the polish ripples in an attempt to dry it.

Therefore, it is an object of the present invention to provide a device used when applying and drying nail polish and the like.

It is another object of the present invention to provide a device used when applying nail polish which provides direct illumination on a fingernail to be polished.

It is a further object of the present invention to provide a device used when applying fingernail polish and the like having direct lighting means and finger locating means to position a fingernail in the path of the direct lighting means.

It is still a further object of the invention to provide a device used when applying fingernail polish on which a fingernail can be polished and dried without moving one's hand.

It is yet another object of the present invention to provide a device used when applying fingernail polish and the like on which a finger can be placed in various relaxed positions for applying and drying fingernail polish on a fingernail.

BRIEF SUMMARY OF THE INVENTION

The device used when applying fingernail polish and the like to a fingernail according to this invention comprises a housing, a finger insert for positioning a finger on the housing, lighting means in the housing for providing direct illumination on the finger insert, a motorized fan for drying a polished fingernail, means for actuating the lighting means and the motorized fan and an air inlet in the housing for supplying air to the fan. The device also includes an air outlet in the housing for directing air blown by the fan at the finger insert. The fan and the lighting means are controlled independently of one another so that a fingernail is polished and then dried without moving the finger and risking the possibility of inadvertently marking the polish before it is completely dry.

In a preferred embodiment of the invention, a heater is provided in the air outlet between the fan and the finger insert so that air blown by the fan and directed at the finger insert is heated by the heater to provide a heated stream of air for decreasing the drying time of the nail polish. The finger insert can also be rotatably mounted on the housing so that the finger can be placed in various relaxed positions in the path of the lighting means and heated stream of air.

DESCRIPTION OF THE DRAWINGS

The aforementioned and other objects, advantages and features of the invention will become apparent in the following detailed description of the preferred embodiments according to this invention as shown in drawings wherein.

DETAILED DESCRIPTION OF THE PREFERRED EMBODIMENTS

Figures 1, 2, 3:
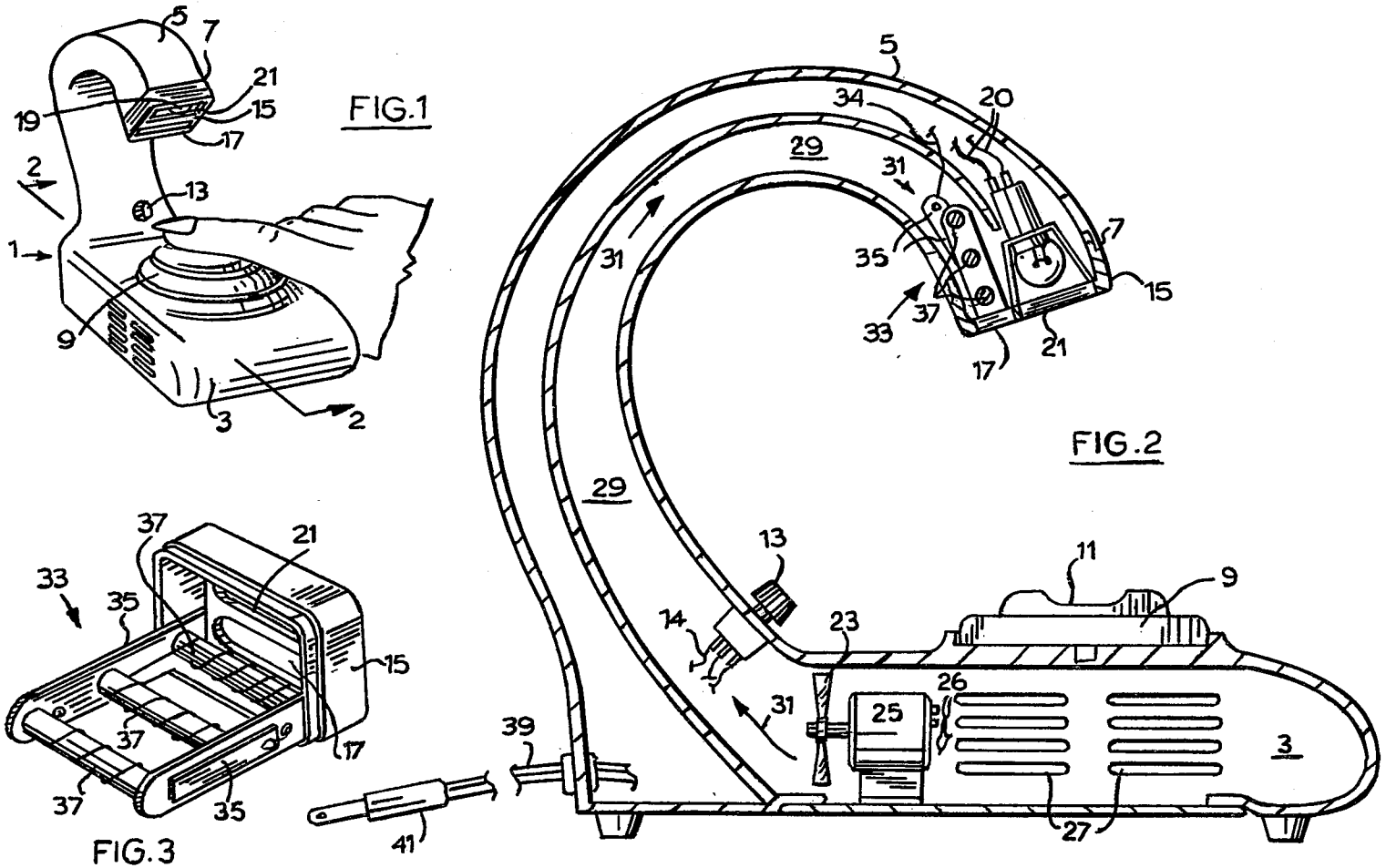
FIG. 1 is a top front plan view of a device used when applying nail polish according to a preferred embodiment of the invention.
FIG. 2 is a sectional view of the device taken along the line 2—2 of FIG. 1
FIG. 3 is a perspective view of a heater and air outlet according to this invention.

Referring to FIGS. 1 and 2, the device includes a housing generally indicated at 1. The housing consists of a base 3 and a hollow arched portion 5 extending upwardly from the base. Arched portion 5 has a downwardly depending end 7 positioned directly above a rotatably mounted finger pad 9 provided with a finger insert 11 in which a finger is placed. Switch 13 is provided on base 3 of the housing. The switch is a multiple type switch such as a multiple push or turn micro switch.

As best shown in FIGS. 1 and 3, downwardly depending end 7 of hollow arched portion 5 is provided with attachment 15 having an air outlet or air vent 17. Lightbulb 19 fixed inside the hollow arched portion shines through aperture 21 provided in attachment 15 so that the light from the lightbulb provides direct illumination on finger insert 11 of rotatably mounted finger pad 9.

Fan 23 is provided in base 3 and is actuated by motor 25. Located on the side of the base are a number of air inlets 27. Arched portion 5 is provided with a channel 29 which extends between attachment 15 and fan 23. Heater 33 is arranged in the channel adjacent air vent 17 of attachment 15. The heater includes two plates 35, connected by heating elements 37.

Lightbulb 19 is connected to multiple switch 13 by electrical wires 20. Motor 25 and heater 33 are connected to the switch by wires 26 and 34 respectively. The switch in turn is connected to cord 39 provided with plug 41 which is inserted in an electrical outlet (not shown).

When a person wishes to polish a fingernail, the finger is placed in finger insert 11 and finger pad 9 is rotated until the finger rests in a relaxed position directly below attachment 15 provided on the end of hollow arched portion 5. Lightbulb 19 is then turned on and the light rays emanating from the bulb shine through aperture 21 directly on the fingernail to be polished. Polish is then applied to the fingernail and if all areas of the nail are not accessible or clearly visible, the finger is moved by rotating the finger pad without removing the finger so that polish can be applied evenly over the entire surface of the nail.

After the polish has been applied, the finger is left in the finger insert for drying of the polish. Heater 33 is turned on and simultaneously motor 25 is energized to rotate fan 23. The fan draws air through air inlets 27 and forces the air through channel 29 of hollow arched portion 5 in the direction of arrows 31. The air which is heated as it passes over the heater escapes through air outlet or vent 17. The air outlet which is located directly above the finger pad is arranged such that the heated air is directed at the fingernail so that the polish is quickly and easily dried without having to remove the finger from the finger insert. It should be noted that the air blowing through air outlet 17 contacts the fingernail at approximately 90° to the nail surface so that the polish dries very evenly to provide the nails with a professional appearance.

It is understood that heater 33 can be eliminated so that the air escaping through vent 17 is not heated. However, even when unheated, the stream of air effectively dries the nail polish in a professional manner. In another embodiment of the invention the heater is eliminated and the lightbulb is secured in the hollow arched portion such that the fan blows air over the lightbulb to provide a heated stream of air. The heated stream of air escapes by the air outlet through which the lightbulb shines. The air outlet is arranged with respect to the finger insert such that a finger nail can be both polished and dried without removing the finger from the finger insert.

It also is understood the finger pad and finger insert need not be rotatably mounted on the base. However, the finger insert should be located such that when a finger is placed therein the fingernail is easily accessible for the application and drying of fingernail polish and the like.

As can be appreciated from the drawings, the housing can have any desired shape with lighting means positioned such that it provides direct illumination on the finger insert. Also, a number of finger inserts can be provided on the housing and the device can be adapted so that there are both lighting means and drying means for each insert. Each lighting means and drying means can be provided with its own switch for independent control of the various components.

Although various preferred embodiments of the invention have been described herein in detail, it will be understood by those skilled in the art that variations may be made thereto without departing from the spirit of the invention or the scope of the appended claims.

What we claim is:

1. A device used for the application of fingernail polish and the like, said device comprising a housing, including a base portion and an upright portion; said upright portion being provided with a downwardly facing free end; said base portion being provided on its upper surface with a horizontally disposed finger pad rotatable in a generally horizontal plane and provided with a finger insert located below said downwardly facing free end; lighting means in said upright portion for providing direct illumination on said finger insert; fan means in said housing for blowing air through said downwardly facing free end at essentially right angles to said finger insert for drying a polished fingernail and an air inlet in said housing for supplying air to said fan; said lighting means and said fan means being operable independently of one another; said finger insert being located centrally of said finger pad; such that it remains beneath the downwardly facing free end when rotating the finger pad for both polishing and drying the fingernail.

2. A device as claimed in claim 1, when provided with heating means located in said housing between the fan means and the finger insert so that the air blown by the fan means and directed at the finger insert is heated by the heating means.

* * * * *